United States Patent [19]

Bishop

[11] 4,028,590

[45] June 7, 1977

[54] ANTI-STATIC BAR

[75] Inventor: Peter Bishop, Portland, Maine

[73] Assignee: United Industrial Syndicate, Inc., Portland, Maine

[22] Filed: Dec. 15, 1975

[21] Appl. No.: 640,578

[52] U.S. Cl. ..... 361/220
[51] Int. Cl.[2] ..... H05F 3/04
[58] Field of Search ..... 317/2 R, 2 F, 4

[56] References Cited

UNITED STATES PATENTS 3,551,743 12/1970 Koepke ..... 317/2 F

*Primary Examiner*—Harry E. Moose, Jr.

[57] ABSTRACT

An anti-static bar has its discharge points established by the serrated edge of a thin metal strip serving as a conductor and held in an insulator extending lengthwise of a channel in the supporting member.

12 Claims, 4 Drawing Figures

ANTI-STATIC BAR

BACKGROUND OF THE INVENTION

Static electricity presents problems in many operations. Where such problems occur, anti-static bars are employed to establish a field of ionized air through which material is passed and by which the charge thereon is neutralized.

It is, of course, well known that the essential requirement of such bars or neutralizers is that they be able to create a field adequate to effect neutralization of the static charge carried by the material and at the same time be so constructed that there is minimal electrical leakage except via their discharge points. It is the discharge points that are not only essential to the effectiveness of the bars but also are the source of production problems and a major factor in their cost.

THE PRESENT INVENTION

The general objective of the present invention is to provide static discharge bars that combine increased effectiveness in use with advantages in production, an objective attained with an anti-static bar, the supporting member of which has a lengthwise channel in which insulating means are secured. A conductor in the form of a thin metal strip, one edge of which is serrated, extends lengthwise of the supporting member with its other edge portion held by the insulating means parallel to but between the side walls of the supporting member with its serrated edge exposed adjacent their edges thereby providing a series of discharge points.

Another objective is to provide that such a bar can be manufactured with maximum ease and convenience, an objective attained with the supporting member an extrusion having a rib extending lengthwise of the interior of each side wall and adjacent the bottom wall, the insulating means an extrusion of the cross sectional size and shape of approximately the inner half of the supporting member and having a slit extending lengthwise thereof to accommodate the conductor and interconnected adjacent its bottom end slidably receiving and holding keepers extending transversely through slots spaced lengthwise of that portion of the conductor that is to be held within the insulating means.

BRIEF DESCRIPTION OF THE DRAWINGS

A preferred embodiment of the invention is illustrated by the accompanying drawings

THE PREFERRED EMBODIMENT OF THE INVENTION

Figure 1:
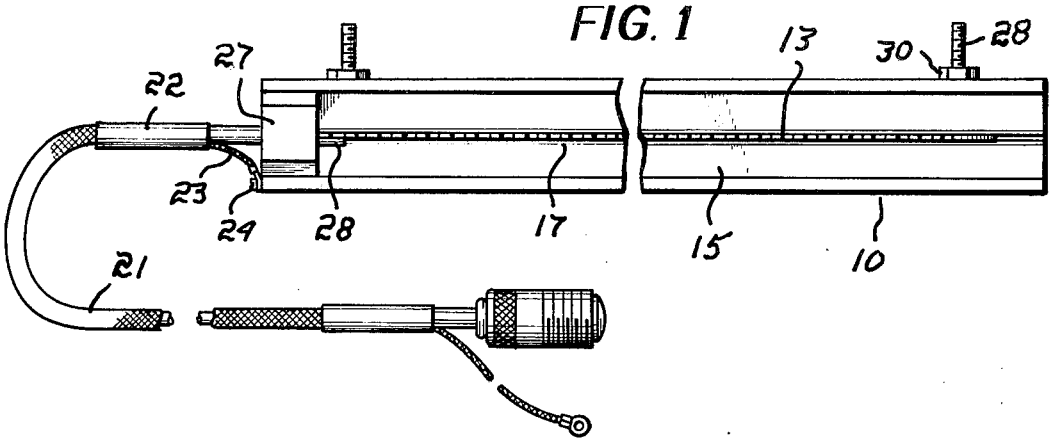
FIG. 1 is a view, in elevation of an anti-static bar in accordance with the invention with the bar positioned to expose the serrated conductor.
Figure 2:
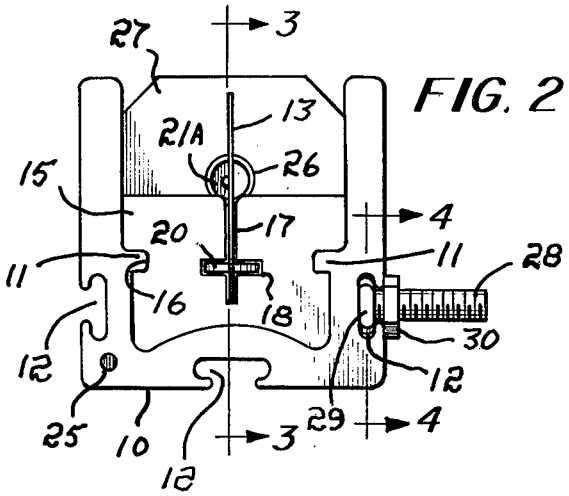
FIG. 2 is an end view of the bar, on an increase in scale.
Figure 4:
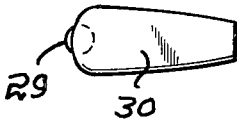
FIG. 4 is a view of a mounting stud as seen from the head end thereof.

The anti-static bar illustrated by the drawings includes a channelled support 10, in practice a desired length of an aluminum extrusion having lengthwise internal ribs 11 in its side walls adjacent the convex bottom wall. The outer surfaces of the side and bottom walls of the support 10 have undercut channels 12, preferably T-shaped in cross section.

The conductor 13 is a thin stainless steel strip having one edge serrated to provide a lengthwise series of discharge points or tips 14. The strip 13 is in the approximate range of from 0.005 to 0.0003 inches in thickness and in practice its thickness is 0.001. While such strips provide effective discharge points, they must be supported throughout their length.

Such a support is provided by the insulator 15 which is shown as a plastic polyvinyl chloride extrusion complemental in cross sectional size and shape to the inner part of the channelled support 10 and thus has channels 16 to slidably receive the ribs 11. In practice, the insulator 15 is anchored in the support 10 by an epoxy. The insulator 15 is also provided with a central slit 17 intersected by a transverse slit 18 relatively near its bottom.

Figure 3:
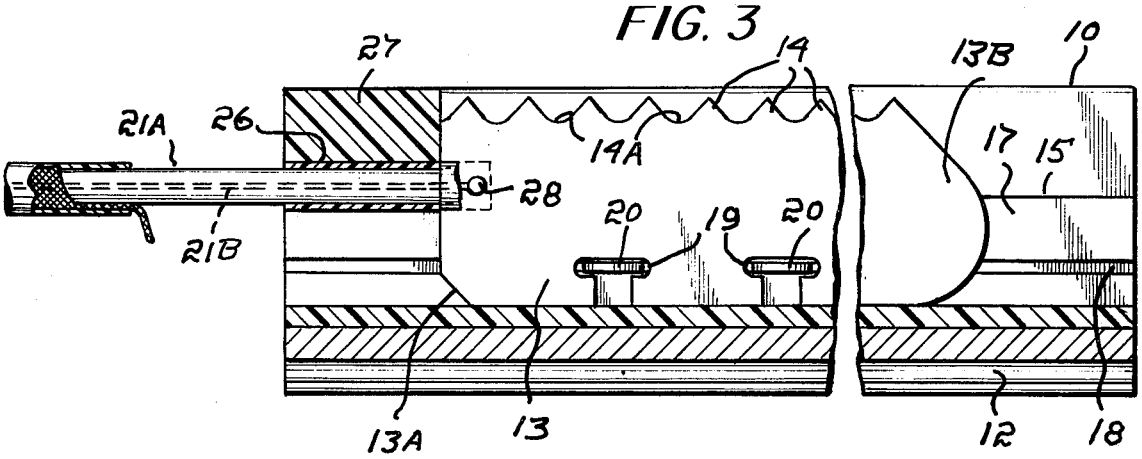
FIG. 3 is a section taken approximately along the indicated line 3—3 of FIG. 2.

As will be apparent from FIG. 3, the conductor 13 has a series of slots 19 spaced parallel and close to its unserrated edge and in practice the slots are T-shaped. The conductor is secured in its insulator 15 by sliding it lengthwise into the slit 17 and as each slot 19 nears an end of the insulator 15, a washer 20 is inserted therein and its exposed margins enter the slits 17. The washers 20 are dimensioned to slide in the slits 17 but to be held thereby against unwanted movement thereby providing firm anchorage for the conductor 13 against vertical displacement.

A sheathed cable 21 for attachment to a suitable power supply, not shown, has a short length of shrink tubing 22 adjacent one end thereof which is brought through the braid with a portion 23 thereof attached to the support 10 as by a screw 24 threaded into one end of a passage 25 extending through the support 10. Between the tubing 22 and the free end of the cable 21, the cable sheath is removed and the cable extends through a sleeve 26, in practice, a length of polyvinyl tubing, with the insulation stripped back from its end and its conductor connected to the conductor 13 as by soldering it thereto. At the cable-entering end of the support 10, a short block 27, in practice a molded or machined section of polyvinyl chloride is a press fit in the support 10 and is secured to the insulator 15 and/or the support 10 as by an epoxy thus to secure the cable sleeve 26.

In practice, the conductor 13 is cut from a coil to the desired length with the ends of the conductor to which the cable conductor is to be soldered clipped at its inner edge as at 13A and its other end rounded as at 13B. A practical advantage of conductors in accordance with the invention is that they enable an anti-static bar to have its effective length (the distance between the discharge points at its ends) sufficiently close to the overall length of the bar that a bar will meet the requirements of a customer whether or not the order specifies on which measurement the order was based. In practice, the end discharge points 14 are in the approximate range of from one-half to three-quarters of an inch from the ends of the supporting member 10.

While the serrated edge may be of any typical "saw tooth" configuration with angular junctions between adjacent points 14 it is preferred that the points 14 be in the form of isosceles triangles and, desirably, their apices are spaced by a distance that does not materially exceed and is preferably less than a quarter of an inch apart in order that the distribution of the field of ionized air will be more uniform than has hitherto been possible. Because the conductor stock is so thin that they may tear at the point junctions, it is preferred that the junctions be arcuate as indicated at 14A.

Such bars are provided with threaded mounting studs 28 each having its head 29 dimensioned to slidably fit in that one of the undercut channels 12 that is appropriate for a particular installation. A nut 30 threaded on the exposed end of each stud and against the supporting member 10 may clamp it against lengthwise movement.

I claim:

1. An anti-static bar including a supporting member having a lengthwise channel, a conductor in the form of a thin metal strip having a serrated edge, insulating means within said channel and secured to said member, means connecting said serrated conductor in said insulating means with said conductor extending lengthwise of said channel parallel to but between the side walls of the member with its serrated edge protruding from said insulating means and exposed adjacent the edges of said walls to provide a series of discharge points, and a cable attached to said member with its conductor connected to the serrated conductor.

2. The anti-static bar of claim 1 in which the thickness of the conductor is in the approximate range of from 0.005 to 0.003 inches, and the maximum spacing between the apeces of the teeth is in the order of one-quarter inch.

3. The anti-static bar of claim 1 in which the thickness of the conductor is approximately 0.001 of an inch.

4. The anti-static bar of claim 2 in which each point defined by the serrated edge is substantially in the shape of an isosceles triangle.

5. The anti-static bar of claim 4 in which the junction between each two points is arcuate.

6. The anti-static bar of claim 1 in which the insulating means extends the full length of the supporting member and has a lengthwise slit in which the conductor is received.

7. The anti-static bar of claim 6 in which the insulating means has a slit transversely intersecting said conductor-receiving slit, the serrated conductor has a series of lengthwise slots spaced along the portion within the lengthwise slit of the insulating means, and the means connecting the serrated conductor to the insulating means are keepers, one in each of the slots of the serrated conductor and extending therethrough, the thickness of the keepers such as to be slidable fit in the transverse slit of the insulating means.

8. The anti-static bar of claim 7 in which the supporting member includes internal ribs extending along the inner surface of its sides a substantial distance below their edges and the insulating means is an extrusion of a cross sectional size and shape such that it is a slidable fit within the channel and held against movement vertically relative thereto by said ribs and to be spaced below the edges of the side walls of the supporting member.

9. The anti-static bar of claim 8 in which the supporting member has a series of external undercut channels extending from end-to-end thereof, one along each side wall and one along the bottom wall, and threaded mounting studs, each having a head dimensioned to be a slidable fit in a selected one of said undercut channels and a nut threaded on the exposed end of the stud and against the supporting member to clamp that stud in a selected position.

10. The anti-static bar of claim 8 in which the cable overlies an end of the insulating means and the end of its conductor is soldered to the serrated conductor, and an insulator block shaped and dimensioned to fit the channel of the supporting member above the insulating means and the cable is secured thereto.

11. The anti-static bar of claim 1 in which the apices of the points are spaced apart by a distance in the order of one-quarter of an inch.

12. The anti-static bar of claim 1 in which the apices of the points are spaced apart a distance less than one-quarter of an inch.

* * * * *